US006162570A

United States Patent [19]

Maess et al.

[11] Patent Number: 6,162,570

[45] Date of Patent: Dec. 19, 2000

[54] ELECTROPHOTOGRAPHIC PRINTING PROCESS FOR PRINTING A CARRIER

[75] Inventors: Volkhard Maess, Erding; Martin Schleusener, Zorneding, both of Germany

[73] Assignee: Océ Printing Systems GmbH, Poing, Germany

[21] Appl. No.: 09/117,929

[22] PCT Filed: Mar. 13, 1997

[86] PCT No.: PCT/DE97/00510

§ 371 Date: Nov. 24, 1998

§ 102(e) Date: Nov. 24, 1998

[87] PCT Pub. No.: WO97/37286

PCT Pub. Date: Oct. 9, 1997

[30] Foreign Application Priority Data

Mar. 29, 1996 [DE] Germany ..... 196 12 762

[51] Int. Cl.[7] ..... G03G 13/056

[52] U.S. Cl. ..... 430/51; 430/54; 430/55; 399/139; 399/145

[58] Field of Search ..... 430/54, 55, 51; 399/139, 145

[56] References Cited

U.S. PATENT DOCUMENTS

| | | | |
|---|---|---|---|
| 3,124,456 | 3/1964 | Moore . | |
| 3,704,121 | 11/1972 | Makino et al. | 430/54 |
| 3,821,931 | 7/1974 | Yamaji et al. . | |
| 4,071,361 | 1/1978 | Marushima | 430/54 |
| 4,230,783 | 10/1980 | Aoki et al. | 430/55 |
| 4,358,520 | 11/1982 | Hirayama . | |
| 4,444,859 | 4/1984 | Mimura . | |
| 5,053,304 | 10/1991 | Mey et al. . | |

FOREIGN PATENT DOCUMENTS

| | | |
|---|---|---|
| 1 522 567 | 9/1969 | Germany . |
| 1 497 164 | 10/1973 | Germany . |
| 27 41 713 | 3/1978 | Germany . |

OTHER PUBLICATIONS

Diamond, Arthur S. (editor) Handbook of Imaging Materials. New York: Marcel–Dekker, Inc. 160–165, 202–204, 227, 1991.

Patent Abstracts of Japan—European Patent Office—Publication No. 57105755—Publication Date Jan. 7, 1982—Canon Inc.

*Primary Examiner*—Christopher D. Rodee

*Attorney, Agent, or Firm*—Schiff Hardin & Waite

[57] ABSTRACT

In an electrophotographic printing process as well as an electrophotographic printer for printing a substrate, a photosensitive layered system is brought to a homogeneous initial state by impressing an electrical field having a first direction. The photoconductive layer is exposed with predetermined image structures according to the image. The entire photoconductive layer is exposed uniformly through the cover layer and/or the electrode layer. Charged toner particles are applied to the cover layer in a development step. The toner image is then transferred to the substrate. If more than one copy is required, the development step and the transfer step are carried out a number of times, the electrical charge image present inside the layered system being retained. The substrate is conveyed at a very high speed by a conveyor device in this operational state.

17 Claims, 3 Drawing Sheets

ELECTROPHOTOGRAPHIC PRINTING PROCESS FOR PRINTING A CARRIER

BACKGROUND OF THE INVENTION

The invention relates to an electrophotographic print method for printing a carrier, in which a photosensitive layer system having an electrode layer, an insulating cover layer, and a photoconductor layer arranged between the electrode layer and the cover layer is brought into a homogeneous initial state by impression of an electrical field in a first direction. The photoconductor layer is exposed according to the image through the cover layer or through the electrode layer with predetermined image structures, whereby a second electrical field with an opposed direction is impressed on the layer system so that a charge image corresponding to the image structures arises in and on the layer system. The entire photoconductor layer is subsequently uniformly exposed through the cover layer and/or through the electrode layer, so that a potential image corresponding to the image structures arises on the surface of the cover layer. In a developing step, charged toner particles are subsequently applied to the cover layer, which particles settle according to the potential image as a toner image that is subsequently transferred to the carrier.

The manufacturing of the charge image and of the potential image with the above-named layer system and the steps stated above resembles the method known under the name "Katsuragawa method" "Canon np-process" (cf. e.g. U.S. Pat. No. 3,124,456; DE 1 497 164, or DE 1 522 567). In known print methods of this type, a different image structure can be predetermined from print image to print image. However, with print methods of this type, only print speeds are achieved that lie well below those of offset printing. With an offset printer, up to approximately 2500 print images per minute can currently be printed. However, offset printing has the disadvantage that before printing a print image, a print mask must be prepared inside or outside the offset printer. This results in an expensive print method that works economically only beginning with a number of copies of some hundreds of print images. A rapid change of the image structures is also not possible, and is usually at least on the order of minutes.

In U.S. Pat. No. 4,444,859, electrophotographic methods are explained in which, after exposure according to the image of a light-sensitive layer system, n-copies of the image are printed without the execution of a renewed intermediate exposure. The layer systems, which contain an upper insulating layer, a photoconductor layer and a lower electrode layer, ensure that the photoconductor, which is also mechanically sensitive, is protected by the upper insulating layer during the developing process.

In Patent Abstracts of Japan, vol. 6, no. 195 (Oct. 5, 1982), JP-A-57-105755, an electrophotographic copier is explained that copies at a first speed given an edition n=1, and copies at a speed higher in comparison with the first speed given an edition n>1. The design of the layer system or the influence of the layer system on the print quality is not specified. A technology of n-edition printing is specified in which a toner image is fixed on the photoconductor drum.

DE-A-27 41 713 relates to a method and a means for stabilizing an electrostatic charge image in which the stabilization is achieved by means of the selection of a suitable potential for the production of the charge image.

In U.S. Pat. No. 5,053,304, a layer system is explained for electrophotographic n-edition printing without intermediate exposure.

In U.S. Pat. No. 3,821,931, a copier is explained in which an electrophotographic printer and an offset printer are combined.

SUMMARY OF THE INVENTION

An object of the invention is to indicate a method for electrographic n-edition printing in which the images are printed with high print quality without intermediate exposure.

This object is achieved for a method of the type named above in that given an edition greater than 1 the developing step and the transfer step are executed while maintaining the electrical charge image present in the interior of the layer system.

The invention is based on the knowledge that electrophotographic methods have proven useful but do not have a sufficiently high print speed given an edition greater than 1, while precisely in the case of an edition greater than 1, in principle an exposure need take place only once, since the image structures are the same for each print image of the edition. For this reason, in a print method according to the invention, given an edition greater than 1 the development step and the transfer is step are carried out in multiple fashion while maintaining the charge image present in the interior of the layer system. In particular, the exposure according to the image, the uniform exposure, and a production of the homogeneous initial state are omitted. By this means, the print speed can be increased considerably given an edition greater than 1. Moreover, given an edition greater than 1 the printing is carried out with a low energy consumption, since the named steps are omitted. By means of the omission of a cleaning step in which residual toner particles are removed from the layer system, the service life of the layer system is increased substantially. In the invention, the developing step and the transfer step are carried out in multiple fashion, in immediate chronological succession. This means that the developing step and the transfer step are carried out successively without the interposition of an exposure according to the image, a uniform exposure, or production of the homogeneous initial state.

In an embodiment of the invention, the charge image in the interior of the layer system is localized between the covering layer and the photoconductor layer. The charge image is thereby located in deep traps. This means that practically no lateral displacement of the charge can occur. Even given the use of conductive substances, e.g. liquid toner, what is known as image running does not take place. Moreover, this charge image remains practically unchanged under the effect of light. The consequence is that a high limit number of copies can be achieved up to which the print images of an edition have a sufficiently good quality.

In order to enable the charge image in the interior of the layer system essentially to be maintained given an edition greater than 1, in embodiments of the invention measures are taken by means of which the charge image remains essentially unchanged during application of the charged toner particles in the developing step and during the transfer of the toner image to the carrier. Thus, for example, the application of the toner particles can be carried out via an air gap between the covering layer and a toner particle carrier for the application of the toner particles.

The print method according to the invention is preferably used in a high-performance printer. With a control unit, changeover can take place between print operation with an edition of 1 and print operation with an edition greater than 1. Given printing with an edition greater than 1, the print speed is substantially increased according to the above by means of a corresponding controlling of the print process.

In a further embodiment of the invention, the exposure according to the image is carried out shortly before or at the beginning of the impression of the second electrical field. The exposure according to the image thereby takes place in line-by-line fashion, by means of an LED row driven according to the image structures or by means of a laser beam modulated according to the image structures, so that a digital printing is carried out.

If an intermediate carrier is used as a carrier, from which in a further transfer step the toner image is transferred onto a sheet-type material, e.g. paper, the wear on the layer system can be reduced, since the intermediate carrier can be manufactured from a material that mechanically attacks the covering layer only slightly during the transfer of the toner image.

If an insulating intermediate layer is located between the photoconductor and the electrode layer, the contrast and/or the sensitivity of the layer system during exposure are increased, whereby the quality of the print images is further increased.

In addition, the invention relates to an electrophotographic printer comprising a control unit for controlling a print process. A transport unit is provided for transporting a carrier. A photosensitive layer system has an electrode layer, an insulating cover layer, a photoconductor layer arranged between the electrode layer and the covering layer, a blocking layer between the photoconductor layer and the electrode layer, and an intermediate layer with deep traps for charge bearers between the photoconductor layer and the covering layer. A corona discharge unit produces a homogeneous initial state of the layer system by impressing an electrical field in a first direction. An exposure unit exposes, according to the control unit, the layer system according to an image to provide image structures of the image on the photoconductor layer. A further corona discharge unit provides a second electrical field with an opposed direction which is impressed on the layer system. A further exposure unit provides a uniform exposure of the layer system. A developer unit applies charged toner particles on a surface of the covering layer. A transfer printing station transfers a toner image formed from the toner particles onto the carrier, the carrier being transported past the transfer printing station by a transport system. The control unit optionally controls the print process in a first operational state I with an edition equal to 1, or in a second operational state II with an edition greater than 1. The transport system transports the carrier with first speed in the operational state I and with a speed greater than the first speed in the operational state II. The effects cited above also apply generally for the electrographic printer according to the invention. The electrographic printer according to the invention unites the advantages of the known electrophotographic printing and offset printing, since it prints an item of print information present in electronic form without the preparation of a print mask, with an edition of one, and with variable print content from page to page, with the speed of a known electrographic printer, or, optionally, with an edition greater than 1 at a considerably higher print speed that is comparable with the print speed of offset printing.

In the invention, the layer system used can form a flat surface or a curved surface. Moreover, the layer system can optionally consist of a flexible material or a rigid material.

In the following, the invention is specified on the basis of embodiments.

DESCRIPTION OF THE PREFERRED EMBODIMENTS

Figure 1:
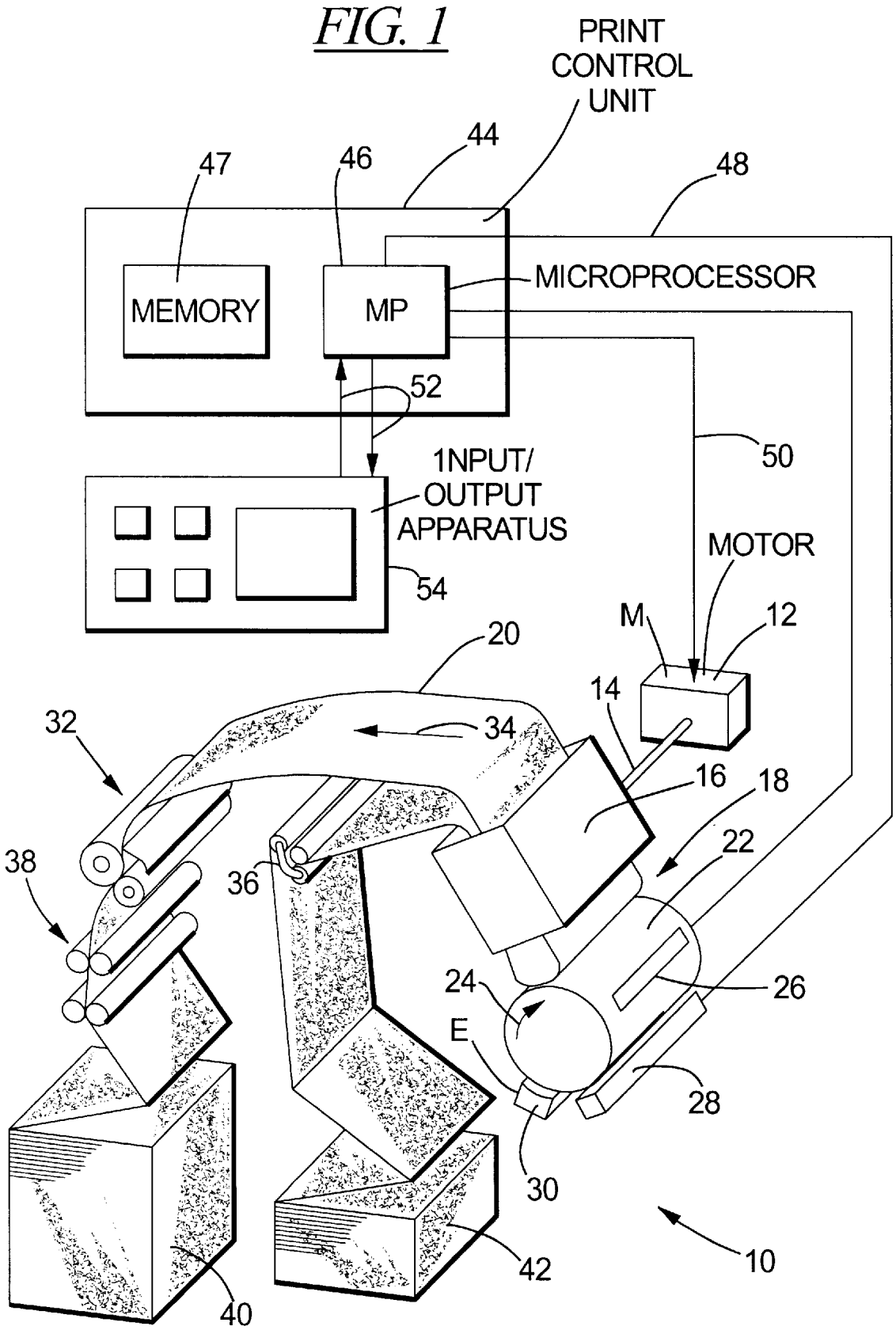
FIG. 1 shows a view of the design of an electrographic printer with essential electronic and mechanical functional units.

FIG. 1 shows a schematic view of an electrographic printer 10 with essential electrical and mechanical functional units. The printer 10 has a transport unit 16 driven by a motor 12 via a shaft 14, which is arranged in the vicinity of a transfer printing station 18 and transports endless stock 20 past the transfer printing station 18, essentially according to a predetermined print speed VD. Alternatively to the endless stock 20, individual pages can also be printed, given a modified transport.

In the transfer printing station 18, a charge image applied to a photoconductor drum 22 and tinted with toner is transferred to the stock 20 by unit of a corona means (not shown). The photoconductor drum 22 thereby rotates in the direction of an arrow 24. After the transfer printing, residual toner that may remain is removed in an erase unit 26, and a residual charge image in a photoconductor layer on the photoconductor drum 22 is erased if necessary. The effective switching of the erase unit 26 depends on whether the printer 10 is in a first operational state I or in a second operational state II. In the operational state I, the printer 10 operates in the manner of a known electrographic printer in which items of print information that are variable from print image to print image can be printed. In the operational state II, a single print job with an edition greater than 1 is printed.

In the operational state II, in contrast to the operational state I, the photoconductor drum 22 is exposed according to the image only once per edition, with the aid of an exposure row 28 of LED diodes, according to a predetermined image structure. This process is explained in further detail below on the basis of FIG. 3. There subsequently occurs a uniform exposure of the photoconductor drum 22 by unit of an exposure means (not shown). By means of the two exposure steps and the action (explained below) of external electrical fields, a potential image that corresponds to the image structures arises on the surface of the photoconductor drum 22.

If the photoconductor drum 22 rotates further, in both operational states I and II its surface is led past a developer station 30. In the developer station 30, charged fixed toner particles are applied according to a known method.

As already mentioned, in both operational states I and II the charge image tinted with toner is subsequently transferred onto the stock 20 in a transfer step, using the corona unit. In the operational state II, in contrast to operational state I, a predetermined number of print images, e.g. 100 print images, are subsequently printed on the stock 20 one after the other chronologically and spatially, without activation of the erase unit 26 and the exposure row 28.

After the stock 20 has been transported past the transfer printing station 18, in both operational states I and II it is supplied to a fixing station 32 in which the still-blurrable toner image is sealed into the stock in blur-proof fashion with the aid of pressure and temperature. A first deflection unit 36 is arranged before the transfer printing station 18, seen in the direction of transport indicated by an arrow 34, which deflection unit supplies the stock 20 to the transfer printing station 18. A second deflection unit 38 is arranged after the fixing station 32, as seen in the direction of transport. This second deflection unit 38 stacks the printed stock 20 on a stack 40. At the beginning of the print process, the stock 20 is removed from a stack 42 by the first deflection unit 36. Instead of the two stacks 40 and 42, rollers are also used on which the stock 20 is rolled up.

The print process is controlled by a print control unit 44 that contains a microprocessor 46 and a memory 47. The microprocessor 46 executes a print program stored in the memory 47. The print control unit 44 predetermines the image structures, and transmits image signals belonging to these image structures to the exposure row 28 via a bus system 48. In the operational state I, upon printing of each individual print image new image signals are transmitted by means of the print control unit 44. The motor 12 is thereby driven by the print control unit 44 via a control line 50 in such a way that it has a lower speed in comparison to the operational state II. Alternatively, the print control unit 44 can also reduce the transport speed of the stock 20 in the operational state II with the aid of a set of gears (not shown).

In the operational state II, the motor 12 is correspondingly driven in such a way that the stock 20 has a higher transport speed than in the operational state I. Moreover, in the operational state II the exposure row 28 is used only for exposure given the first print image of the document. The erase unit 26 is not used in operational state II, since the charge image in the photoconductor layer of the photoconductor drum is retained over the entire document.

The print control unit 44 is connected with an input/output apparatus 54 via data lines 52, via which apparatus, among other things, the desired operational states I or II can be predetermined by an operator.

Figure 2:
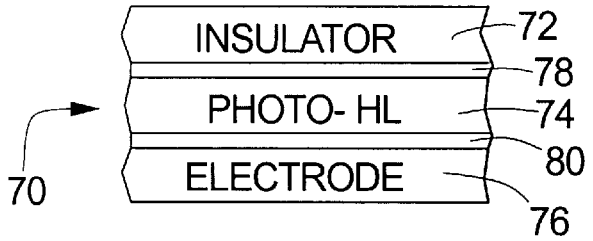
FIG. 2 shows a schematic view of a photosensitive layer system.

FIG. 2 shows a photosensitive layer system 70 applied to the photoconductor drum 22. The layer system 70 contains an insulating cover layer 72 made of a transparent material, a photoconductor layer 74 located thereunder, e.g. made of a flexible organic photoconductor (OPC) of the n-conductivity type, and a lower electrode layer 76 made of a sufficiently conductive material, such as e.g. copper.

In FIG. 2, a greatly enlarged intermediate boundary layer 78 is shown between the cover layer 72 and the photoconductor layer 74. A blocking layer 80 is shown between the photoconductor layer 74 and the electrode 76. The boundary layer 78 and the blocking layer 80 are provided in the respective edge regions of the photoconductor layer 74.

Figure 3A:
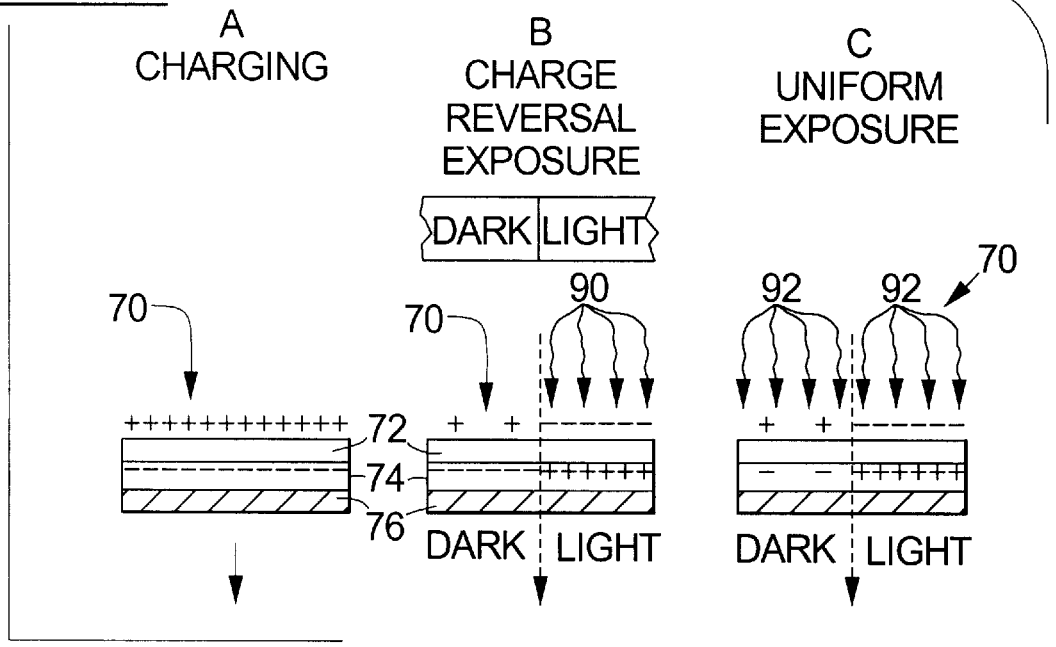
FIG. 3 shows a schematic view of the charge image and of the potential image in the photosensitive layer.
Figure 3B:
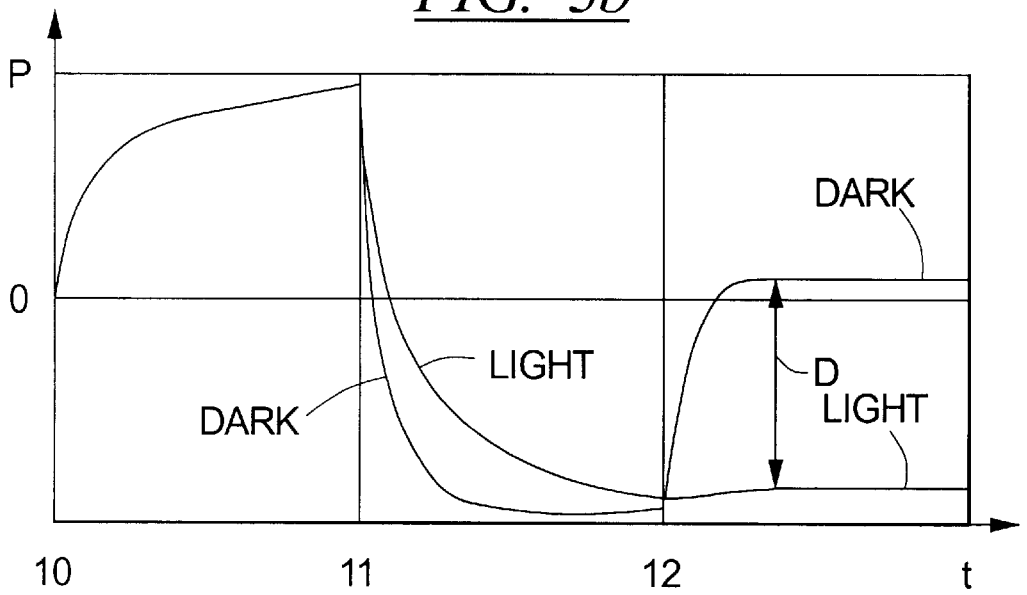

FIG. 3 shows a schematic view of the charge images and the potential images in the layer system 70 in the print method used in the printer 10 for the production of the charge image. In a part a of FIG. 3, the charge image is shown in and on the layer system 70 for three steps A, B and C. In Step A, a charging of the layer system 70 is carried out; in Step B a charge reversal and exposure according to the image are carried out; and in Step C a uniform exposure of the layer system 70 is carried out.

In a Part B, the potentials on the surface of the layer system 70 are shown in each of the Steps A–C for light and dark image structures. The time t is thereby plotted on the abscissa axis and the potential P is plotted on the ordinate axis.

In Step A, there takes place the charging of the layer system 70 applied on the photoconductor 22 by unit of a corona means (not shown). The layer system is thereby brought into a homogeneous initial state. In this state, positive charge bearers are located on the surface of the insulating covering layer 72, which charge bearers are distributed uniformly. As opposite poles thereto, negative charge bearers are located in the boundary layer 78, which are essentially likewise distributed uniformly in the boundary layer. The potential curve on the surface of the covering layer 72 is such that during the time of Step A, which is carried out between a time t0 and t1, a positive potential is built up that approximates the voltage of the corona unit.

In the following Step B, there takes place a charge reversal and simultaneous exposure according to the image of the layer system 70 by means of the light-emitting diodes of the exposure row 28, whereby with the aid of a further corona unit an electrical field is impressed on the layer system 70, which field has a polarity opposed to that of the electrical field in Step A. A charge reversal by the additional corona unit is made more difficult at darkened points of the layer system 70, since in the dark the photoconductor layer 74 has a high resistance.

The charge bearers in the photoconductor layer 74 cannot leave this layer, due to the photoelectric characteristics of the photoconductor layer. By unit of the further corona means, a charge reversal nonetheless also takes place in the darkened areas. In the electrode layer 76 there are located positive charge bearers, which stand opposite negative charge bearers in the photoconductor layer 74, which no longer have positive charge bearers on the surface of the covering layer 72, because these were removed by the further corona charge reversal. These positive charge bearers also cannot penetrate into the is photoconductor layer 74, due to the photoelectric characteristics of the photoconductor layer 74.

Light beams 90 impinge in the regions of the layer system 70 illuminated by the exposure row 28. The light beams 90 effect an altered photo-electrical behavior of the photoconductor layer 74, which becomes low-ohmic. By this means, the charge reversal effected by the further corona unit can be carried out completely in the illuminated areas. Negative charge bearers settle on the surface of the covering layer 72. These negative charge bearers stand opposite positive charge bearers in the photoconductor layer 74, which come into the photoconductor layer 74 from the electrode layer 76. The distribution of potential on the surface of the layer system 70 is shown in part b of FIG. 3 between time t1 and a time t2. The potentials for light and dark regions hardly differ in their magnitude at time t2. The bright areas have a negative potential due to the negative charges on the surface of the covering layer 72, and the darkened regions have an approximately equal negative potential on the surface of the covering layer 72, due to the negative charges in the photoconductor layer 74.

In Step C, there takes place a uniform exposure, by means of beams 92, of the overall layer system 70 in the longitudinal axis of the photoconductor drum 22 for a strip. The uniform exposure can for example be carried out by means of a further exposure row in which all light-emitting diodes have uniform brightness.

By means of the uniform exposure, the overall photoconductor layer 74 becomes low-ohmic. In the regions that were already illuminated in Step B, the charge image in the layer system 70 does not change. In the areas that are darkened in Step B, due to the changed characteristics of the photoconductor layer 74, which is now also low-ohmic there, there takes place a charge compensation, as a result of which the positive charge bearers of the electrode layer 76 penetrate into the photoconductor layer 74 and neutralize at least a part of the negative charge bearers present there. The potential image on the surface of the covering layer 72 is shown in turn in part b of FIG. 3. By means of the charge compensation, there takes place a boosting of the potential in the dark areas. By this means, there results a potential difference D between light and dark areas. This potential difference has the effect that the charged toner particles adhere to the surface of the covering layer 72 only at the areas illuminated in Step B.

In the operational state II, the charge distribution in the interior of the layer system 70 remains essentially unaltered over a multiplicity of print processes in which an entire print image is respectively printed on the stock 20.

Figure 4:
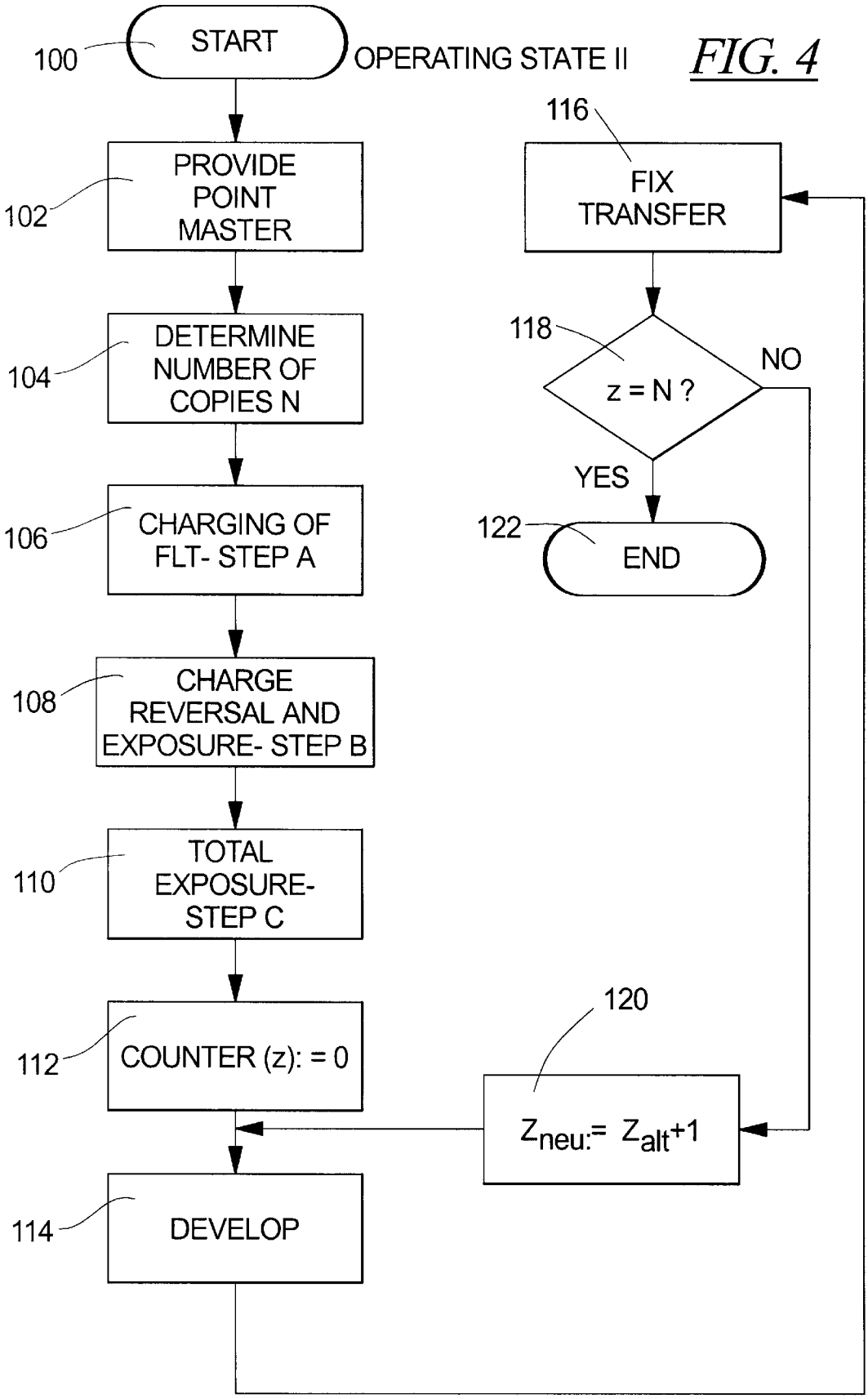
FIG. 4 shows a flow diagram of the print method according to the invention.

FIG. 4 shows a flow diagram of the method according to the invention in the operational state II of the printer 10. In a Step 100, a print cycle is started for a number of copies N, e.g. in that an operator sets the operating state II via the input/output apparatus 54 and inputs a start signal.

By means of the microprocessor 46, in a Step 102 image data concerning image elements of a print image are stored in the memory 47. In a Step 104, the number of copies N is determined by the operator, whereby in the operational state II the number of copies N is greater than 1.

Subsequently, the corona unit for the charging of the layer system 70 according to Step A is activated (Step 106). In a Step 108, the layer system 70 is charge-reversed and is exposed at the same time by means of the exposure row 28 according to the predeterminations of the print control unit 44. In a Step 110, a uniform exposure of the layer system 70 is carried out according to Step C by means of a further exposure row behind the exposure row 38, seen in the direction of rotation 22 of the photoconductor drum.

A counter for counting the printed print images of the respective edition is subsequently set to the value zero (Step 112). By means of the developer unit 30, the toner is applied on the photoconductor drum 22 (Step 114). At the transfer station 18, the transferring of the toner image onto the stock 20 subsequently takes place, which image is fixed in the fixing station 32 (Step 116).

The length of a print image in the direction of transport 34 is limited by the circumference of the photoconductor drum 22. At the latest after the photoconductor drum 22 has carried out a rotation with activated exposure row 28, the corona unit for charging the photoconductor according to Step A, the exposure row 28 and the exposure row for uniform exposure are no longer activated. Steps 114, 116 and Step 118 can be carried out without the action of the print control unit 44 if the counting process is executed by a separate counter that again activates the print control unit 44 upon reaching a counter state that agrees with the number of copies N.

After one revolution of the photoconductor drum, the speed of the photoconductor drum 22 is again essentially increased by means of the print control unit 44, since in particular the step of exposure according to the image is omitted in the printing of the further print images. The erase unit 26 is actuated in operating state 2 only if another document is to be printed.

In a Step 118, it is checked whether the counter has a value that agrees with the number of copies N. If this is not the case, the counter value is increased by the value 1 in a Step 120 and the method is continued in a loop of steps 114 to 120. If it is determined in Step 118 that the counter has a counter value that agrees with the number of copies N, i.e. all print images of the document have already been printed, the printing of the document is terminated in a Step 122.

By means of the print method according to the invention, it is achieved that in the operational state II a print speed of more than 1000 pages per minute is achieved.

Although various minor changes and modifications might be proposed by those skilled in the art, it will be understood that our wish is to include within the claims of the patent warranted hereon all such changes and modifications as reasonably come within our contribution to the art.

What is claimed is:

1. An electrophotographic print method for printing a carrier comprising the steps of:

providing a photosensitive layer system having an electrode layer and an insulating cover layer, a single photoconductor layer only, a blocking layer arranged between the photoconductor layer and the electrode layer, and an intermediate layer with deep traps for charge bearers arranged between the photoconductor layer and the covering layer said photoconductor layer lying between said blocking layer and said intermediate layer;

bringing the layer system into a homogeneous initial state by impression of an electrical field having a polarity in a first direction;

exposing the photoconductor layer according to an image having predetermined image structures through the covering layer or through the electrode layer;

impressing a second electrical field with a polarity in an opposed direction on the layer system so that a charge image corresponding to the image structures arises in an interior of the layer system;

uniformly exposing the entire photoconductor layer through the covering layer or through the electrode layer so that a potential image corresponding to the image structures arises on a surface of the covering layer;

in a developing step, applying charged toner particles to the covering layer which settle according to the potential image to form a toner image;

subsequently transferring the toner image to the carrier; and given an edition greater than 1, carrying out the developing step and the transfer step in multiple fashion while maintaining the electrical charge image present in the interior of the layer system.

2. The method according to claim 1 wherein the developing step and the transferring step are executed in multiple fashion in immediate chronological succession.

3. The method according to claim 1 wherein during the application of the toner particles the electrical charge image in the interior of the layer system remains substantially unaltered.

4. The method according to claim 1 wherein during the application of the toner particles an air gap is present between the covering layer and a toner particle bearer for application of the toner particles.

5. The method according to claim 1 wherein during the transfer of the toner image the electrical charge image in the interior of the layer system is maintained substantially unaltered.

6. The method according to claim 1 wherein the method is used in a high-performance printer printing up to approximately 1000 pages per minute.

7. The method according to claim 1 wherein a control unit switches between a first operation state I for printing with an edition of 1 and a further operational state II for printing with said edition greater than 1 such that in the operational state II the central unit causes a print speed to be substantially increased in comparison to a print speed in the operational state I.

8. The method according to claim 1 wherein the electrical charge image in the interior of the layer system is arranged between the covering layer and the photoconductor layer.

9. The method according to claim 1 wherein a liquid toner is used as the toner particles.

10. The method according to claim 1 wherein a toner powder is used as the toner particles.

11. The method according to claim 1 wherein the exposure according to the image is carried out shortly before or at a beginning of an impression of a second electrical field.

12. The method according to claim 1 wherein the exposure according to the image takes place in line-by-line fashion by use of an LED row driven according to the image structures.

13. The method according to claim 1 wherein the exposure according to the image takes place in line-by-line fashion by use of a laser beam modulated according to the image structures.

14. The method according to claim 1 wherein the carrier is made of sheet material.

15. The method according to claim 1 wherein the carrier is an intermediate carrier from which the toner image is transferred onto a sheet material in a further transfer step.

16. An electrophotographic printer, comprising:

a control unit for controlling a print process;

a transport unit for transporting a carrier;

a photosensitive layer system having an electrode layer, an insulating cover layer, a single photoconductor layer only, a blocking layer between the photoconductor layer and the electrode layer, and an intermediate layer with deep traps for charge bearers between the photoconductor layer and the cover layer, said photoconductor layer lying between said blocking layer and said intermediate layer;

a corona discharge unit for producing a homogeneous initial state of the layer system by impressing an electrical field having a polarity in a first direction;

an exposure unit for exposing the layer system according to an image to provide image structures of the image on the photoconductor layer;

a further corona discharge unit providing a second electrical field with a polarity in an opposed direction which is impressed on the layer system;

a further exposure unit for a uniform exposure of the layer system;

a developer unit for applying charged toner particles on a surface of the covering layer;

a transfer printing station for transfer of a toner image formed from the toner particles onto the carrier, the carrier being transported past the transfer printing station by a transport system;

the control unit optionally controlling the print process in a first operational state I with an edition equal to 1, or in a second operational state 11 with an edition greater than 1; and the transport system transporting the carrier with a first speed in the operational state I and with a speed greater than the first speed in the operational state II.

17. An electrophotographic print method for printing a carrier, comprising the steps of:

providing a photosensitive layer system having an electrode layer and an insulating cover layer, a single photoconductor layer only arranged between the electrode layer and the cover layer, a blocking layer arranged between the photoconductor layer and the electrode layer, and an intermediate layer with deep traps for charge bearers arranged between the photoconductor layer and the cover layer, said photoconductor layer lying between said blocking layer and said intermediate layer;

bringing the layer system into a homogeneous initial state by impression of an electrical field having a polarity in a first direction;

exposing the photoconductor layer according to an image having predetermined image structures;

impressing another electrical field with a polarity in an opposed direction on the layer system so that a charge image corresponding to the image structures arises in an interior of the layer system;

uniformly exposing the entire photoconductor layer so that a potential image corresponding to the image structures arises on a surface of the cover layer;

in a developing step, applying charged toner particles to the covering layer which settle according to the potential image to form a toner image;

subsequently transferring the toner image to the carrier; and given an edition greater than 1, carrying out the developing step and the transfer step in multiple fashion while maintaining the electrical charge image present in the interior of the layer system.

* * * * *